US006585218B1

(12) United States Patent
Friberg

(10) Patent No.: US 6,585,218 B1
(45) Date of Patent: Jul. 1, 2003

(54) PICTURE STAND

(76) Inventor: Nathan J. Friberg, 10545 Maryland Cir., Bloomington, MN (US) 55438

( * ) Notice: Subject to any disclaimer, the term of this patent is extended or adjusted under 35 U.S.C. 154(b) by 0 days.

(21) Appl. No.: 09/906,318

(22) Filed: Jul. 16, 2001

(51) Int. Cl.[7] ..... A47F 1/14; A47G 1/16; B60R 1/02

(52) U.S. Cl. ..... 248/469; 248/163.2; 248/175; 40/749

(58) Field of Search ..... 248/469, 175, 248/116, 465.1, 163.2; 40/749, 759, 606, 607

(56) References Cited

U.S. PATENT DOCUMENTS

| | | | | | |
|---|---|---|---|---|---|
| 266,815 | A | | 10/1882 | Harris | |
| 338,356 | A | * | 3/1886 | Osborn | 248/159 |
| 368,994 | A | | 8/1887 | Choinanus | |
| 613,091 | A | * | 10/1898 | Stengel | 40/749 |
| 728,559 | A | | 5/1903 | Etherton et al. | |
| 896,753 | A | * | 8/1908 | Peterson | 211/50 |
| 1,114,387 | A | | 10/1914 | Rouchaud | |
| 1,398,516 | A | | 11/1921 | Hermanson | |
| 1,542,672 | A | * | 6/1925 | Crapo | 248/116 |
| 1,860,323 | A | * | 5/1932 | Ebeling | 248/158 |
| 1,879,403 | A | * | 9/1932 | Monroe | 248/488 |
| 2,047,075 | A | | 7/1936 | Kremen | |
| 3,370,821 | A | | 2/1968 | Mingis | |
| 3,721,414 | A | * | 3/1973 | Yoder | 248/175 |
| 3,823,969 | A | | 7/1974 | Thell | |
| 3,908,955 | A | | 9/1975 | Frechtman | |
| 3,990,670 | A | | 11/1976 | Frechtman | |
| 4,058,283 | A | | 11/1977 | Frechtman | |
| 4,700,498 | A | * | 10/1987 | Perutz et al. | 40/603 |
| 4,976,409 | A | | 12/1990 | Hansen | |
| 5,477,789 | A | * | 12/1995 | Von Gunten | 108/108 |
| 5,642,820 | A | * | 7/1997 | Angeles | 211/103 |
| 6,045,107 | A | * | 4/2000 | Carlson | 248/175 |
| 6,059,122 | A | * | 5/2000 | Cartmell | 211/13.1 |

FOREIGN PATENT DOCUMENTS

| | | | |
|---|---|---|---|
| GB | 2332138 | * | 6/1999 |

* cited by examiner

*Primary Examiner*—Korie Chan
(74) *Attorney, Agent, or Firm*—James W. Miller

(57) ABSTRACT

A picture stand comprises an upper portion and a lower portion which are joined together and are configured to be non-planar relative to one another, namely the lower portion is at an angle relative to the upper portion. When the lower edge of the lower portion is engaged against a horizontal support surface, such as the top of a desk, the picture stand will lean over to engage the upper portion of the picture stand with a vertical display surface, such as a wall. A picture can be suspended in a flat, upright orientation from a hook provided on the upper portion of the picture stand. Thus; the picture stand allows a picture to be displayed as if the picture were suspended from a picture hanger, but without having to pound any nails into or otherwise damage the wall.

17 Claims, 11 Drawing Sheets

PICTURE STAND

TECHNICAL FIELD

This invention relates to a stand for supporting pictures on a vertical display surface such as a wall. More particularly, this invention relates to a stand that displays a picture in a substantially flat, upright orientation against a wall without having to attach any picture hangers or similar fasteners to the wall.

BACKGROUND OF THE INVENTION

Pictures are often hung on walls using nails or picture hangers. Conventional picture hangers comprise a bracket having an upwardly facing hook with the bracket being nailed to the wall. Whether a picture hanger or a simple nail is used as the support from which the picture is hung, a nail has to be pounded into the wall in either case. This causes a hole in the wall which must later be repaired and repainted if the picture is subsequently removed.

In some settings, such as offices, the walls or partitions forming the office cubicles are not even made of a material which is amendable to having anything nailed into it. Many such office cubicle walls comprise cloth covered steel walls. Trying to pound a nail into such walls is difficult if not impossible to accomplish. In addition, the holes made by nails in such walls are more difficult to repair than holes in wood or sheetrock walls. For example, pounding a nail into the cloth covered walls of a modern office cubicle rips or tears the cloth, rendering repair quite difficult.

As a result of damage to walls which result when nails are pounded into such walls for the support of pictures, there are many locations where hanging pictures from walls using conventional nails or picture hangers is prohibited. For example, many colleges prohibit students from hanging pictures from the walls of their dorm rooms because of the damage caused by the puncture holes to the walls. Similarly, many places of business prohibit hanging pictures from the cloth covered walls of office cubicles. Accordingly, the occupants of these venues are deprived of the pleasure of looking at pictures displayed on a wall.

It is possible to display pictures in other ways. For example, the picture can often be displayed on top of one's desk using the fold-out brace often built as part of the picture frame. Alternatively, some external braces for picture frames are sold separately from the frame to be usable with any picture. One such separate brace is shown in U.S. Pat. No. 3,990,670 to Frechtman.

In addition to braces attached to pictures, many easels are known for displaying a picture. Such easels have various combinations of legs which allow the easels to be self-supporting on a horizontal surface. In addition, the easels have a ledge or the like on which the picture rests for display. The picture when displayed on an easel is usually displayed at an incline to the vertical, namely the picture is not displayed vertically upright but is most often tilted back as it extends upwardly.

The above-described picture braces and picture supporting easels are effective in supporting pictures without hanging them on a wall, thus avoiding the use of nail type picture hangers. However, such picture braces and easels have various disadvantages of their own. For one thing, they tend to require considerable space on a desk or floor. More importantly, they display the picture on top of the desk at an elevation that is usually below eye level and with the picture being in an inclined, rather than vertical, orientation. Thus, they simply do not take the place of something like a picture hanger which displays a picture in a flat, upright orientation against a wall at some selected elevation above the top of a desk or other horizontal support surface.

SUMMARY OF THE INVENTION

It is one aspect of this invention to provide a picture stand for supporting a picture. The picture stand has a lower portion that rests on a horizontal support surface and an upper portion that engages against a vertical display surface. The upper portion of the picture stand extends generally vertically relative to the vertical display surface so that a picture can be suspended or hung on the upper portion of the picture stand and when so suspended or hung will be displayed in an upright vertical orientation.

It is another aspect of this invention to provide a picture stand for displaying a picture in a flat, upright orientation against a vertical display surface and above a horizontal support surface. The picture stand has an upper portion and a lower portion which are configured relative to one another to permit at least some of the upper portion to lean against and engage the vertical display surface when the lower portion engages against the horizontal support surface. The upper portion of the picture stand is configured to suspend or hang the picture therefrom in an upright orientation.

Yet another aspect of this invention is to provide a picture stand for displaying a picture in a flat, upright orientation. The picture stand has edge contact with a horizontal support surface along a line of contact. The picture stand has a center of mass located closer to a vertical display surface than the distance between the line of contact and the vertical display surface such that the picture stand is supported in an upright orientation on the horizontal support surface only by leaning into contact with the vertical display surface. A hook is provided on the picture stand for suspending or hanging a picture therefrom, those portions of the picture stand beneath the hook being arranged to allow the picture to hang vertically in an upright orientation.

A final aspect of this invention is to provide a plurality of picture stands for displaying a plurality of pictures in flat, upright orientations against a vertical display surface and above a horizontal support surface. Each picture stand has a lower portion that rests on a horizontal support surface and an upper portion that extends generally vertically relative to the vertical display surface to suspend or hang a picture from the upper portion in a flat, upright orientation. The upper portions of different picture stands have different heights to allow the pictures to be displayed at different heights above the horizontal support surface.

BRIEF DESCRIPTION OF THE DRAWINGS

This invention will be described hereafter in the Detailed Description, taken in conjunction with the following drawings, in which like reference numerals refer to like elements or parts throughout.

DETAILED DESCRIPTION

Figure 1:
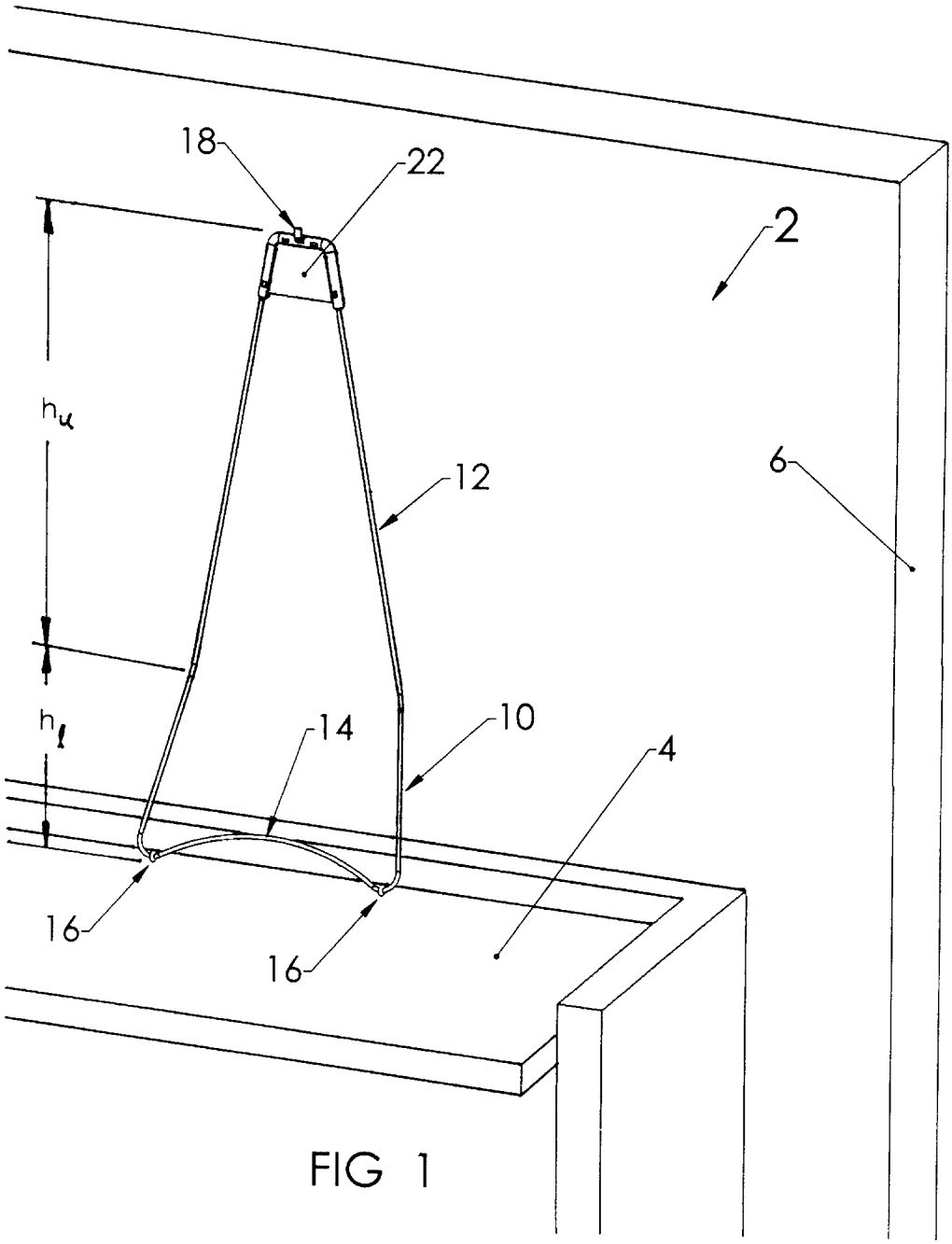
FIG. 1 is a perspective view of a first embodiment of a picture stand according to this invention, showing the picture stand in an upright orientation with its lower portion resting by edge contact with a horizontal support surface, such as the top of a desk, and with its upper portion leaning into engagement with a vertical display surface, such as a wall, but without having a picture suspended or hung from the picture stand.
Figure 2:
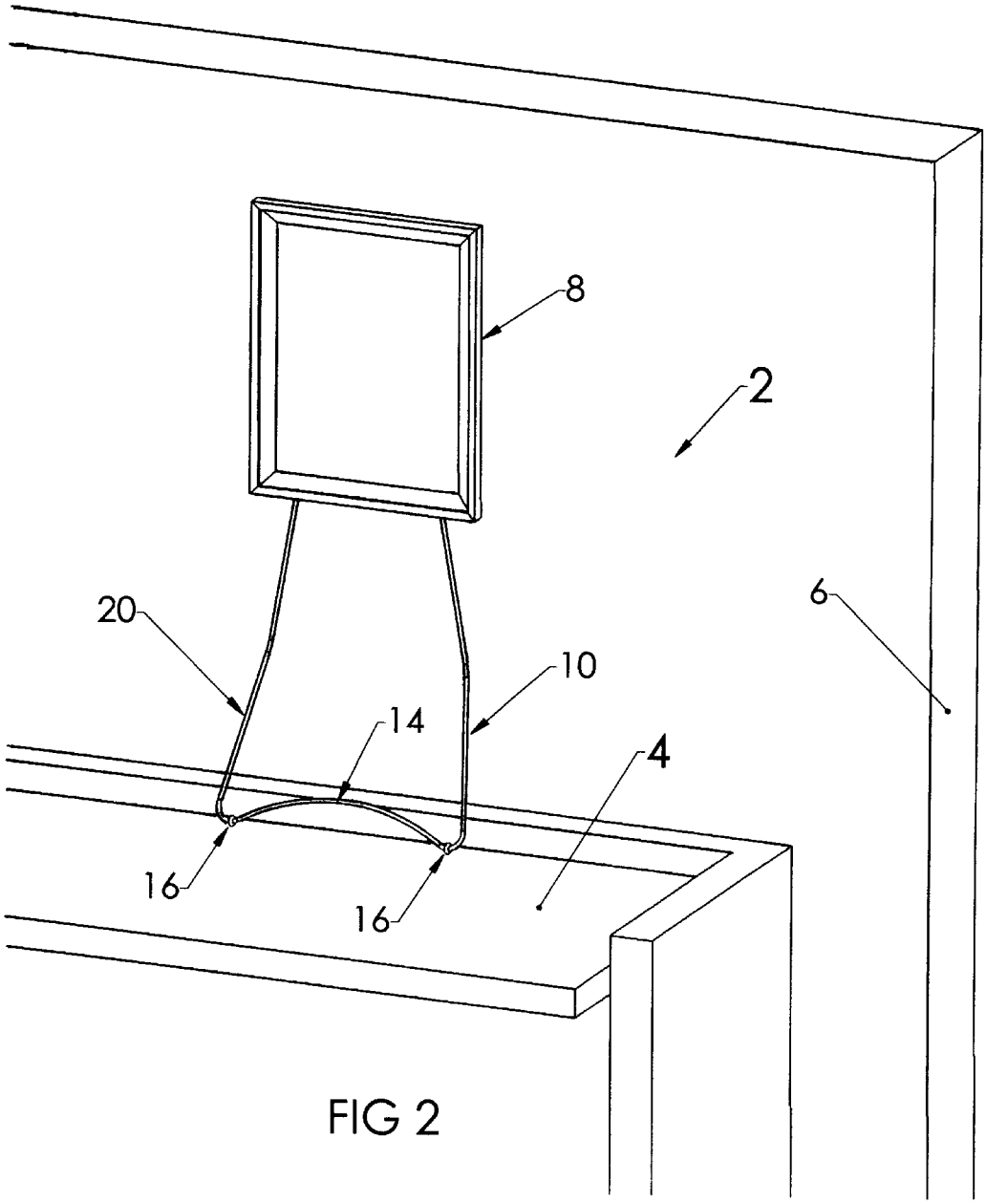
FIG. 2 is a perspective view similar to that of FIG. 1 of the picture stand of FIG. 1, but showing a picture suspended or hung from the picture stand.

A picture stand according to this invention is illustrated generally as 2. In FIG. 1, picture stand 2 is shown in an upright orientation on top of a horizontal support surface 4, such as the top of a desk or table, in engagement with a vertical display surface 6, such as a wall. FIG. 1 illustrates picture stand 2 without any picture supported thereon. FIG. 2 illustrates a picture stand 2 in the same orientation as FIG. 1, but with a picture 8 having been hung from picture stand 2.

The word "picture" is defined in Webster's New Collegiate Dictionary as "a design or representation made by various means (as painting, drawing, or photography)." Such a broad definition of picture is intended to apply to the use of the word picture in this patent application. In other words, the picture image can be any image regardless of how the image is formed so that the word picture will include artwork, photographs, posters, or any other visual image. The word picture is also intended to apply to any visual image whether or not the image is framed or not. While most pictures have frames, some pictures, such as posters, may be unframed.

Figure 3:
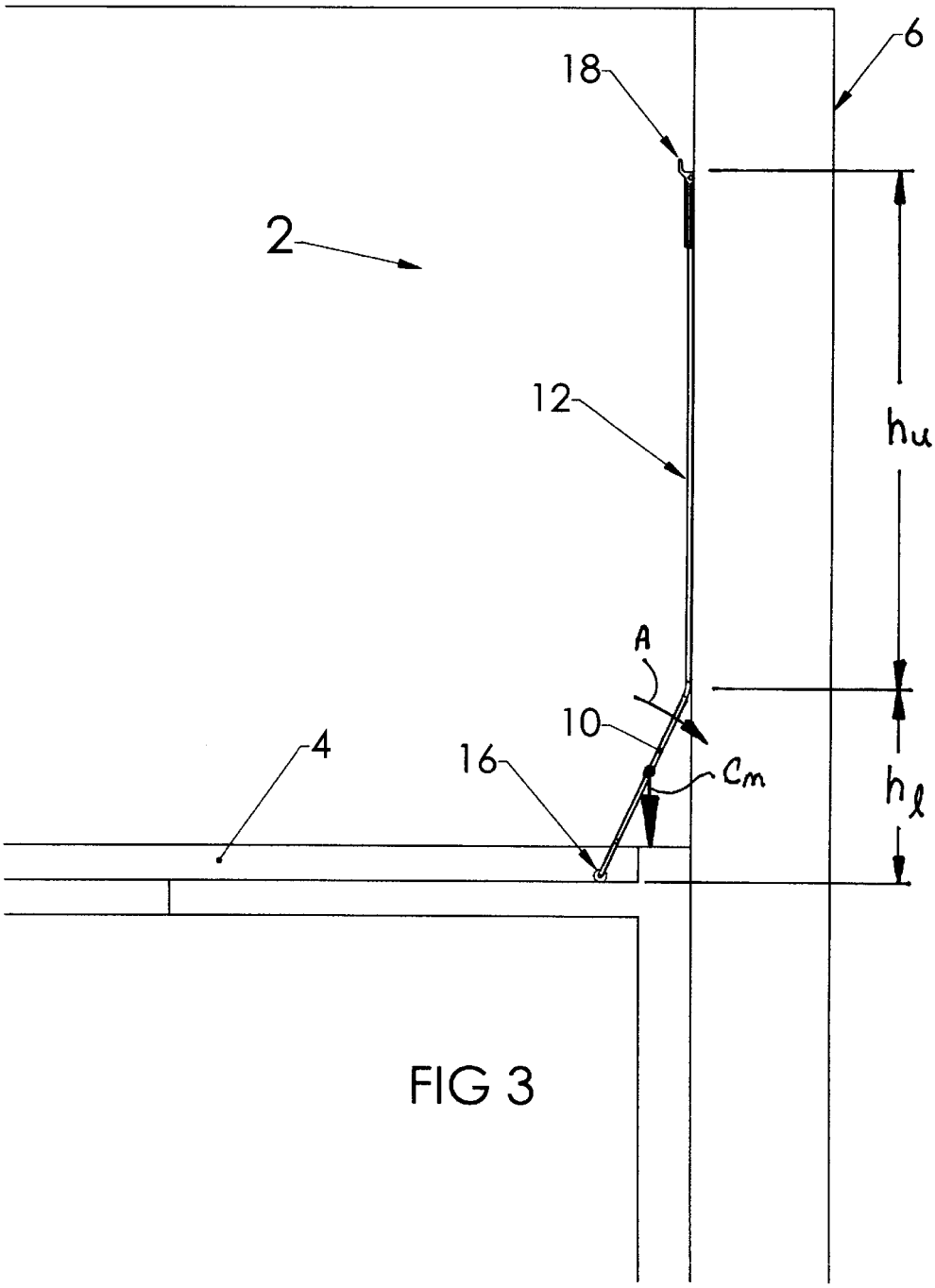
FIG. 3 is a side elevational view of the picture stand of FIG. 1 without a picture suspended or hung from the picture stand.
Figure 4:
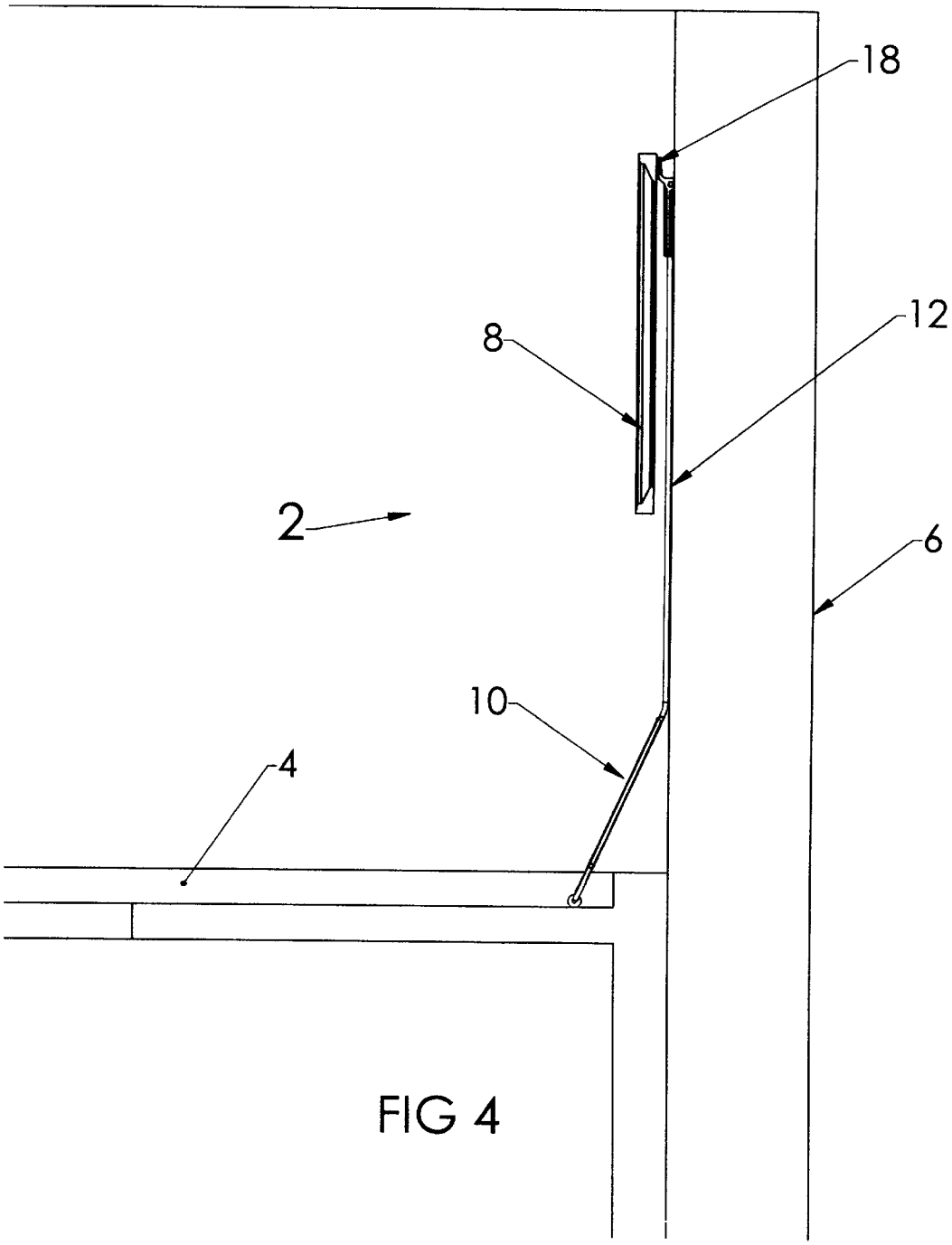
FIG. 4 is a side elevational view of the picture stand of FIG. 1 with a picture suspended or hung from the picture stand.

Picture stand 2 has a lower portion 10 and a conjoined upper portion 12. Lower and upper portions 10 and 12 are not planar relative to one another. Instead, as shown most clearly in the side elevational view of FIG. 3, lower portion is angled relative to upper portion 12. When lower portion 10 of picture stand 2 engages horizontal support surface 4, upper portion 12 of picture stand 2 extends generally vertically relative to vertical display surface 6 and engages against vertical display surface 6 as shown in FIG. 3.

Referring now to FIG. 1, lower portion 10 has a lower edge 14 that bows upwardly in the middle thereof so that each end of lower edge 14 engages horizontal support surface 4 in the manner of spaced, supporting feet. To protect horizontal support surface 4 from being marred by contact with the ends of lower edge 14, and to prevent picture stand 2 from sliding on horizontal support surface 4, a protective bumper or grommet 16, made for example from rubber or felt, can be installed around each end of lower edge 14 to engage against horizontal support surface 4. Bumpers or grommets 16 could obviously be deleted if so desired. In addition, lower edge 14 could be flat, instead of being bowed and the thickness of lower edge 14 could vary. See, for example, the embodiment of the invention shown in FIG. 9 in which lower edge 14 is flat, relatively thick, and has no protective bumpers or grommets.

In plan view, picture stand 2 tapers inwardly as it extends upwardly such that picture stand 2 is narrowest at the top thereof and is widest at the bottom thereof. See FIG. 1. In addition, the height of upper portion 12 of picture stand 2, denoted as $h_u$ in FIG. 3, is chosen to be long enough to allow a picture 8 to be hung thereon with picture 8 lying adjacent the generally vertically extending upper portion 12. Thus, the height $h_u$ of upper portion 12 of a particular picture stand 2 is chosen to be at least as long as the height of a particular picture 8 which is to be supported on picture stand 2. This allows picture 8 to hang vertically in an upright orientation against upper portion 12 of picture stand 2 without engaging against angled lower portion 10 of picture stand 2.

Figure 7:
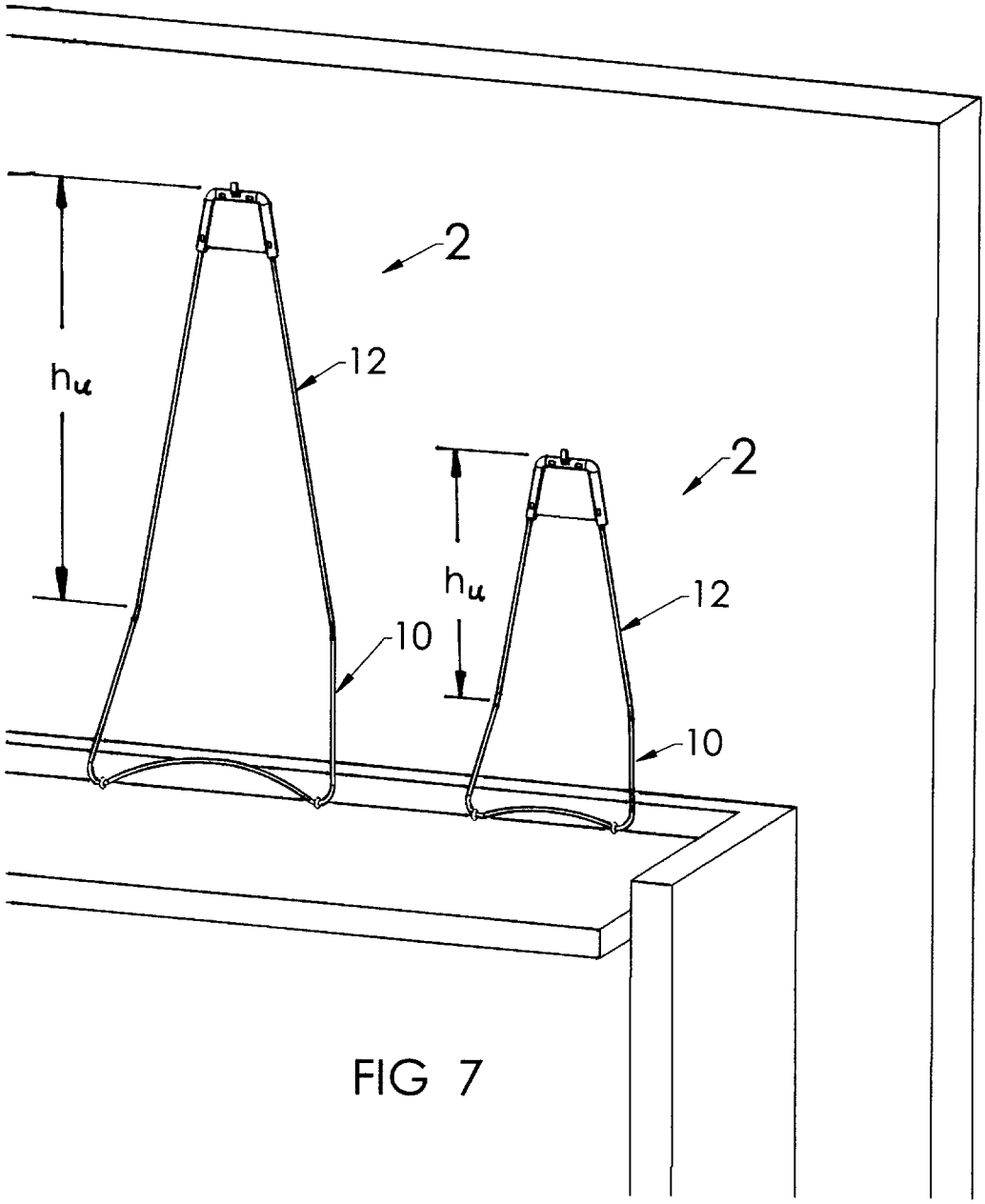
FIG. 7 is a perspective view of a plurality of picture stands as shown in FIG. 1, particularly illustrating picture stands of different heights without any pictures on the picture stands.
Figure 8:
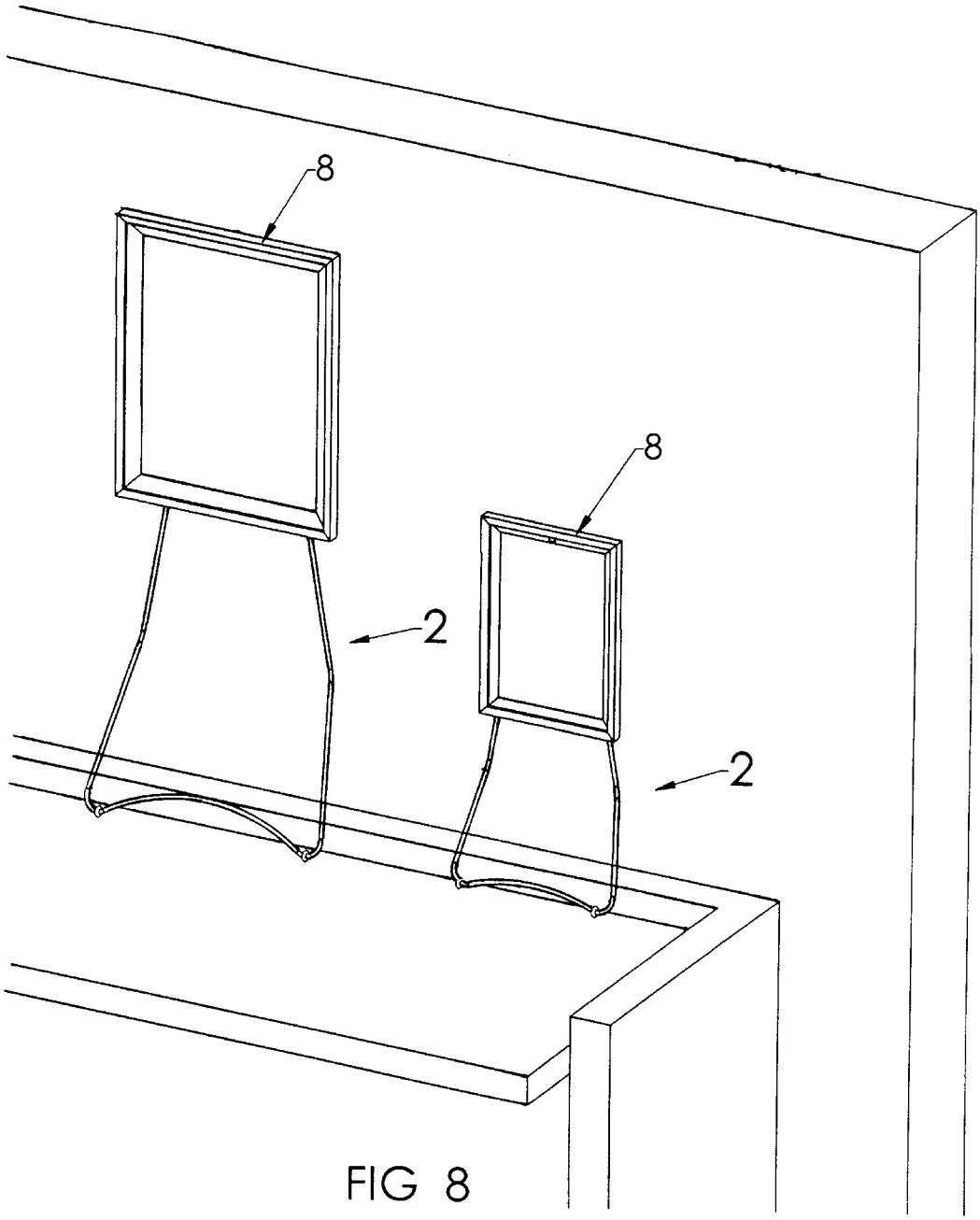
FIG. 8 is a perspective view of a plurality of picture stands of different height similar to those shown in FIG. 7, but showing a plurality of pictures suspended or hung from the picture stands.

Obviously, a picture stand 2 that is designed to hang pictures 8 having a certain height is also useful for hanging shorter pictures. However, different picture stands 2 could be provided with different heights $h_u$ for supporting pictures 8 having different heights. This is illustrated in FIGS. 7 and 8.

The height $h_l$ of lower portion 10 of picture stand 2 is preferably less than the height $h_u$ of upper portion 12 of picture stand 2. As shown in the drawings, the height $h_l$ is approximately one half or so of the height $h_u$. Thus, lower portion 10 of picture stand 2 comprises approximately the lower one third of picture stand 2 while upper portion 12 of picture stand 2 comprises approximately the upper two thirds of picture stand 2. The ratio of $h_1$ to $h_u$ can obviously vary and the height $h_l$ could even be the same as or longer than the height $h_u$. However, it is preferred that the height $h_l$ be small relative to height $h_u$ to minimize how far out lower edge 14 extends from vertical display surface 6 to minimize the amount of horizontal support surface 4 taken up by picture stand 2.

Looking again at the side elevational view of picture stand 2 in FIG. 3, the center of mass of picture stand 2 is illustrated as $c_m$. When picture stand 2 is placed in an upright orientation with lower portion 10 of picture stand 2 engaging horizontal support surface 4, the center of mass $c_m$ is offset from the line of contact of lower portion 10 of picture stand 2 with horizontal support surface 4. This induces a torque, illustrated by the arrows A, tending to rotate picture stand 2 about its line of contact with horizontal support surface 4. If picture stand 2 is not located near a wall or other vertical support surface 6, this torque will rotate picture stand 2 until it falls over onto horizontal support surface 4. In other words, picture stand 2 is not self-supporting on a horizontal support surface 4.

However, when picture stand 2 is placed on a horizontal support surface 4 adjacent a vertical display surface 6, such as a wall, the rotational torque provided by the center of mass $c_m$ acting relative to the line of contact will simply cause picture stand 2 to lean over until upper portion 12 comes into contact with vertical display surface 6. Picture stand 2 will thus be maintained in an upright orientation with its lower portion 10 in engagement with horizontal support surface 4 while its upper portion 12 engages vertical display surface 6 as shown in FIG. 1. In this orientation, picture stand 2 is ready to support a picture thereon.

When picture stand 2 is placed in an upright position on a horizontal support surface 4 with picture stand 2 leaning against a vertical display surface 6, a picture 8 can be supported on upper portion 12 of picture stand 2. To facilitate this support, an upwardly extending catch or hook 18 is provided on the top of upper portion 12 of picture stand 2. Hook 18 receives the support wire or one of the eyelets typically provided on the back of picture 8. Thus, picture 8 can simply be hooked over hook 18 and allowed to suspend itself from hook 18 by simply lying flat against upper portion 12 of picture stand 2. This is illustrated in FIG. 2.

Picture stand 2. of this invention is advantageous because it allows pictures 8 to be displayed flat against a vertical display surface, such as a wall, in the manner of pictures suspended from nails or picture hangers, but without actually using a nail or picture hanger. Thus, the damage normally made in a wall when nails are pounded into the wall is entirely avoided by picture stand 2 of this invention. Picture stand 2 of this invention can support a picture in a flat, upright orientation against a wall without having to pound anything into the wall. Thus, picture stand 2 of this invention can be used in locations, such as college dorm rooms or office cubicles having cloth covered walls, in which the use of picture hangers is often prohibited.

Figure 11:
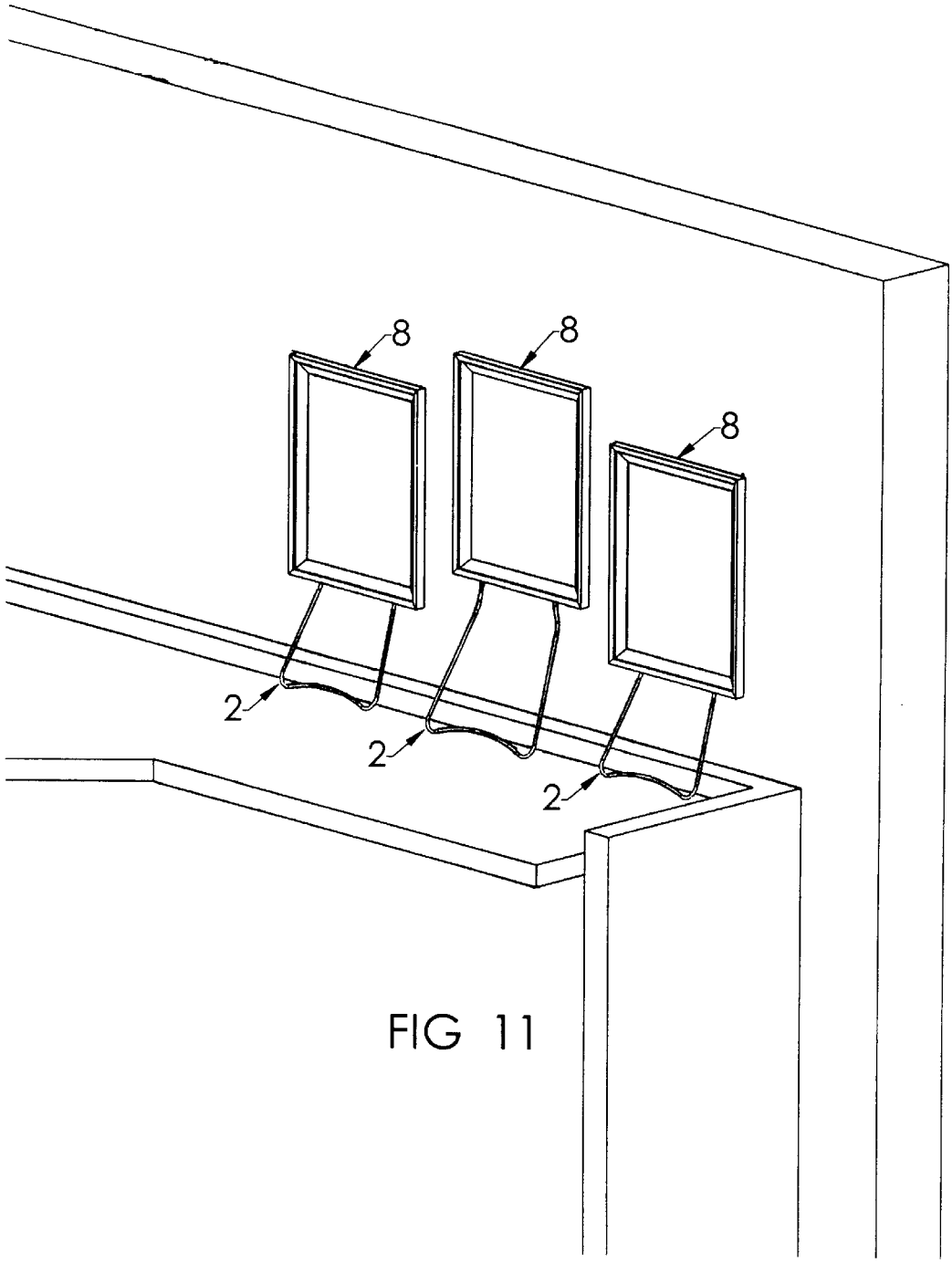
FIG. 11 is a perspective view of a plurality of picture stands of different height similar to those shown in FIG. 7, but showing a plurality of pictures suspended or hung from the picture stands with all of the pictures being the same size.

A plurality of differently sized picture stands could be provided having different heights. This is illustrated as previously noted in FIGS. 7 and 8. When such differently sized picture stands 2 are used adjacent one another, a plurality of pictures 8 can be simultaneously displayed at different or staggered heights. See FIG. 8 which illustrates the display of a plurality of differently sized pictures. FIG. 11 shows a plurality of picture stands 2 being used to support a plurality of pictures 8 of approximately the same size.

Figure 5:
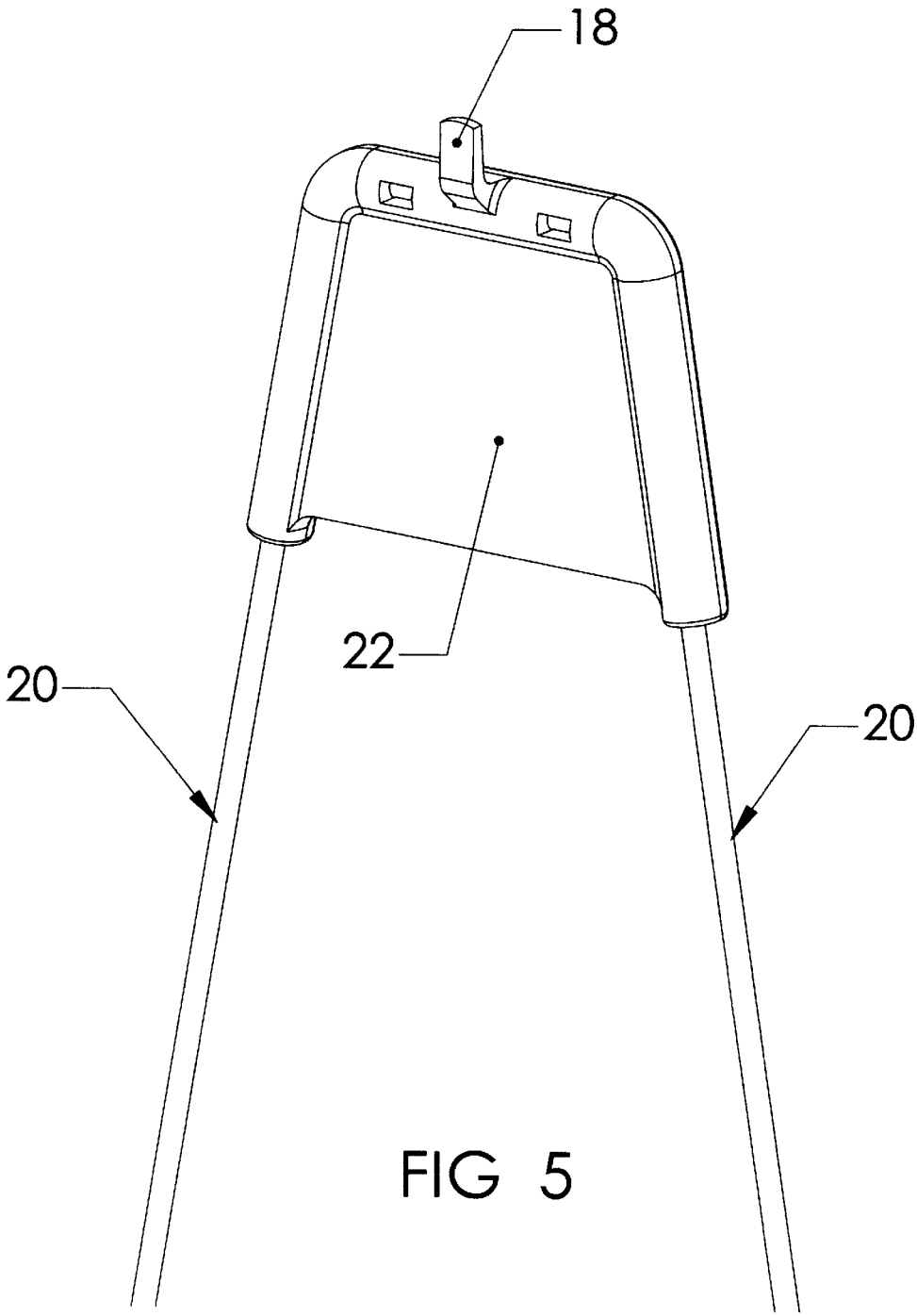
FIG. 5 is an enlarged perspective view of a portion of the picture stand of FIG. 1, showing the hook on the top of the picture stand from which the picture can be suspended or hung.
Figure 6:
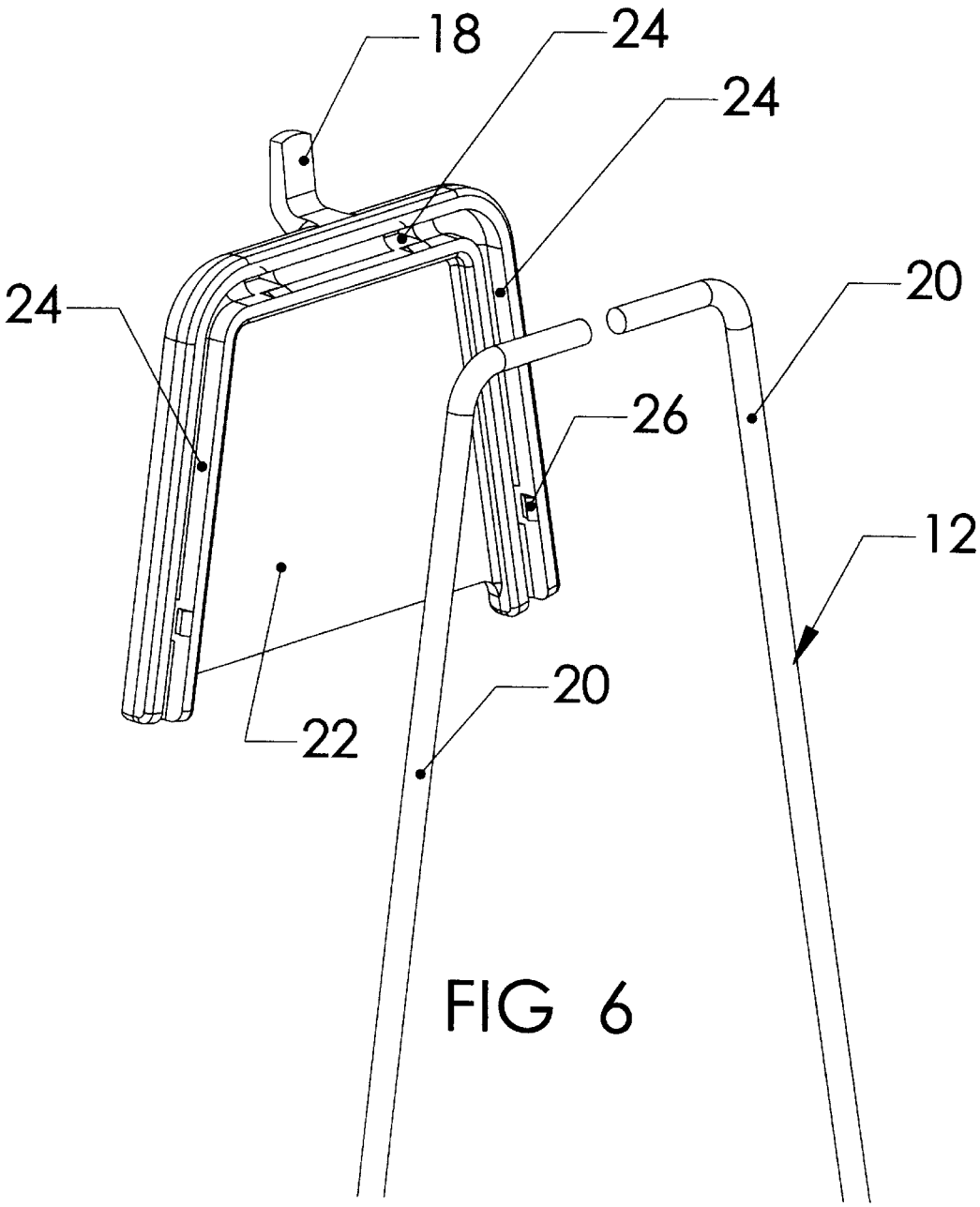
FIG. 6 is an exploded perspective view of a portion of the picture stand of FIG. 1, showing the back of the member that carries the hook to illustrate how this member snap fits over a portion of the wire frame forming the picture stand.

Picture stand 2 can be formed in any appropriate manner. For example, picture stand 2 can formed as a wire frame in which a single piece of wire 20 is bent into the appropriate shape. As shown in FIGS. 5 and 6, a plastic support member 22 carries hook 18 and snap fits onto the top of upper portion 12 of this wire frame. As shown in FIG. 6, wire 20 will be received in a channel 24 in the back of support member 22 and is retained in channel 24 by the press fit which fit can be. enhanced by various retention flanges 26 that overlie wire 20 after wire 20 has been snapped into channel 24.

Picture stand 2 made as a wire frame as described above has the advantage of having its interior be largely open. Thus, picture stand 2 does not itself become obtrusive or cover up much of vertical display surface 6 or horizontal support surface 4. One can look through the wire frame of picture stand 2 and still see the top of the desk or the wall beneath picture 8. Thus, picture stand 2 does not unduly draw attention to itself or distract the viewer when looking at picture 8.

Figure 9:
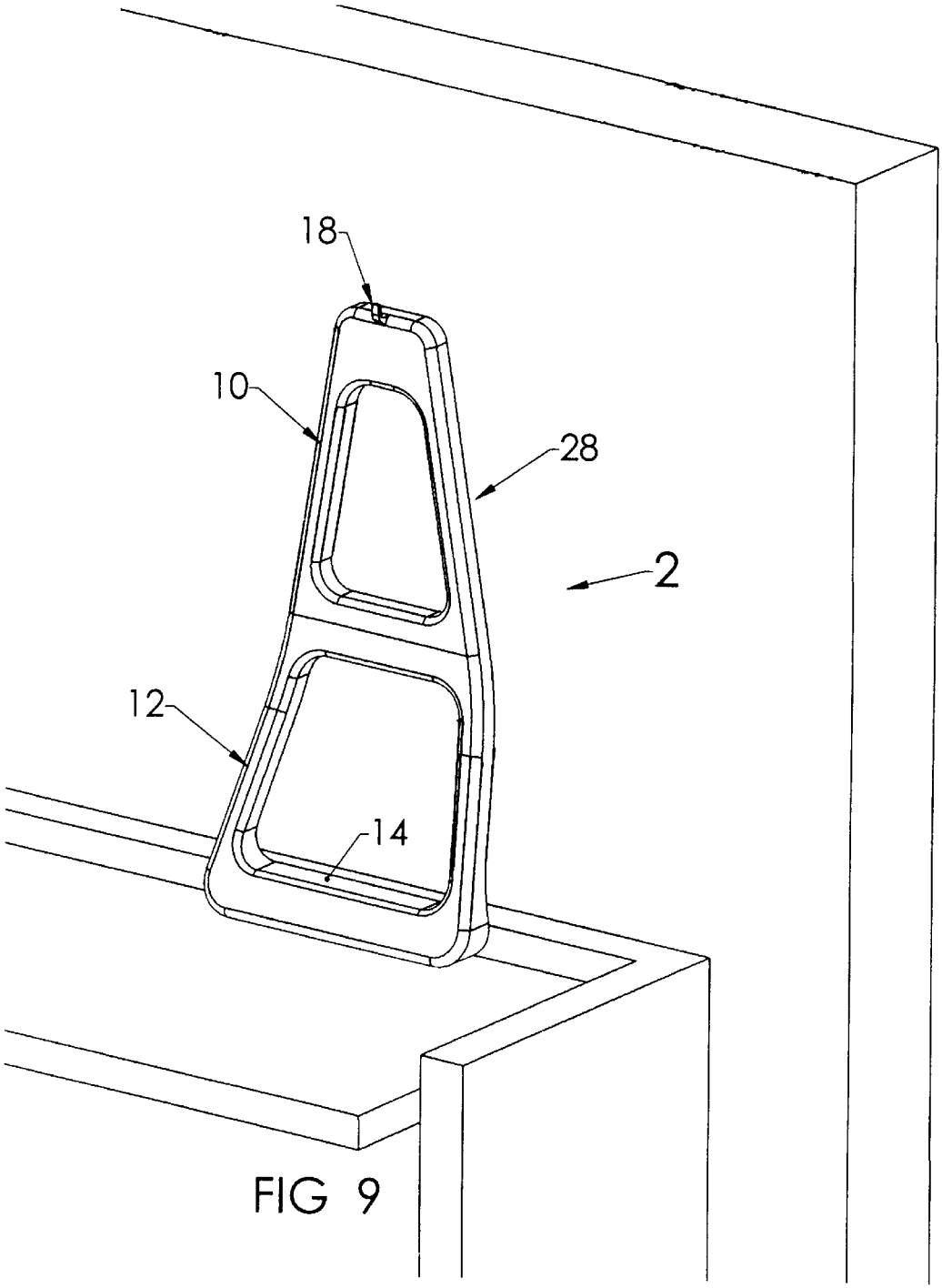
FIG. 9 is a perspective view of another embodiment of a picture stand according to this invention, particularly showing a stand formed as a one-piece molded plastic stand.

Another embodiment of a picture stand 2' according to this invention is illustrated in FIG. 9. In this embodiment, picture stand 2' is molded as a one-piece plastic member 28, rather than being formed as a frame made from a piece of wire 20. In this embodiment, hook 18 is simply molded into the top of picture stand 2' and is not part of a separate support member 22. Portions of the interior of this picture stand 2' can be left open, as illustrated in FIG. 9, or could be closed off if so desired.

Figure 10:
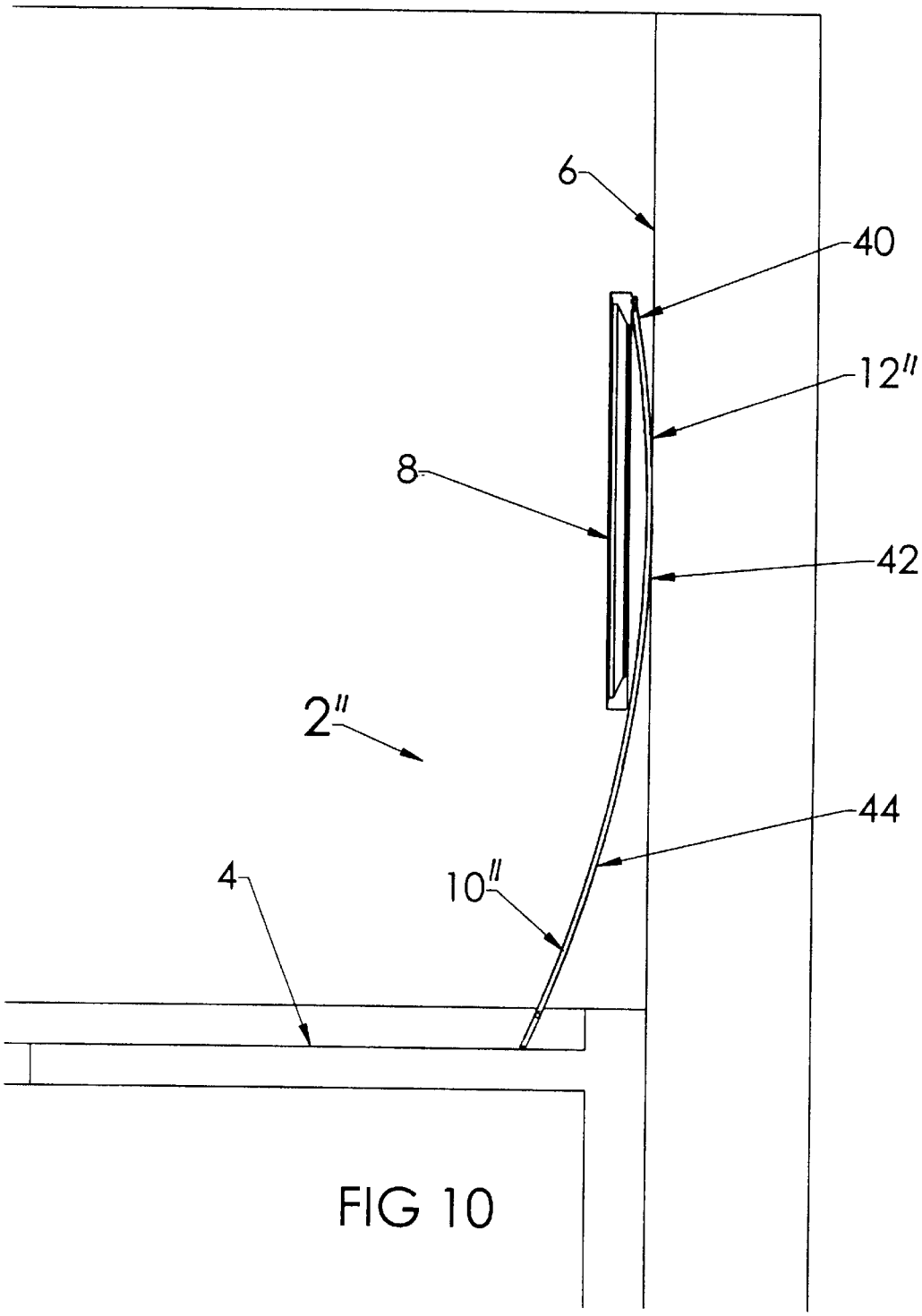
FIG. 10 is a side elevational view of yet another embodiment of a picture stand according to this invention, particularly showing a stand having non-planar upper and lower portions which are formed from adjoining sections of a curve.

Yet another embodiment of a picture stand 2" according to this invention is illustrated in FIG. 10. In this embodiment, the planar lower and upper portions 10 and 12 of picture stand 2 with a sharp angle between the two portions has been replaced by lower and upper portions 10" and 12" formed from adjoining sections of a curve. This curve is configured so that upper portion 12" of picture stand 2 has a generally symmetrical bow shape with the upper edge 40 of the bow extending slightly forwardly of vertical display surface 6, with the central portion 42 of the bow engaging vertical display surface 6, and with lower portion 44 of the bow extending slightly forwardly from vertical display surface 6 by a distance generally equal to upper edge 40 of the bow. This symmetrical bow portion of the curve forms upper portion 12" of picture stand 2" while the rest of the curve continues to curve further forwardly from vertical display surface 6 until it engages horizontal support surface 4.

It should be apparent that picture stand 2" of FIG. 10 permits the generally vertical , upright display of a picture in much the same manner as picture stand 2. Namely, picture 8 can hang vertically downwardly from the top of picture stand 2 over upper portion 12" of picture stand 2" with the symmetrical bow shape of upper portion 12 permitting this vertical hanging. In effect, the symmetrical bow shape of upper portion 12 provides an upper portion 12 that still extends generally vertically in an overall sense relative to vertical display surface 6. Thus, picture stands 2, 2' or 2" according to this invention all have upper portions which extend generally vertically, whether such upper portions are flat or slightly bowed, to permit a generally vertical display of a picture 8 suspended or hung from the picture stands.

Various other modifications of this invention will be apparent to those skilled in the art. For example, while it is preferred that upper portion 12 of picture stand 2 have some type of hook 18 to facilitate the suspension or hanging of picture 8, hook 18 can have shapes or orientations other than that shown herein. In addition, hook 18 could be deleted in its entirety if upper portion 12 has some other structure or shape that is sufficient to catch or hook onto some portion of picture 8 or the support wire or eyelet normally found on the back of picture 8. Accordingly, the invention is to be limited only the by the appended claims.

I claim:

1. A picture stand for supporting a picture, which comprises:

a picture stand having a lower portion that rests on a horizontal support surface and an upper portion that engages adjacent a vertical display surface, wherein the upper portion of the picture stand extends generally vertically relative to the horizontal support surface such that the upper portion of the picture stand extends upwardly along a portion of the vertical display surface, wherein the upper portion of the picture stand is configured so that a picture can be suspended or hung on the upper portion of the picture stand and when so suspended or hung will be displayed in an upright vertical orientation, and wherein the upper portion of the picture stand has a curve with only a portion of the curve in engagement with the vertical display surface.

2. The picture stand of claim 1, wherein the curve is a generally symmetrical bow and the bow engages the vertical display surface in a central intermediate portion of the bow.

3. The picture stand of claim 1, wherein the upper portion of the picture stand carries a hook from which the picture can be suspended or hung.

4. A picture stand for displaying a picture in a flat, upright orientation adjacent a vertical display surface and above a horizontal support surface, which comprises:

(a) a picture stand having an upper portion and a lower portion which are configured relative to one another to permit at least some of the upper portion to lean adjacent and engage the vertical display surface when the lower portion engages adjacent the horizontal support surface;

(b) the upper portion of the picture stand being configured to suspend or hang the picture therefrom in an upright orientation, wherein the upper portion of the picture stand includes a hook having an outermost free end from which the picture is suspended or hung, wherein the hook extends upwardly relative to a top edge of the upper portion of the picture stand with the free end of the hook being at a higher elevation than the top edge of the upper portion of the picture stand such that the free end of the hook forms an uppermost point on the picture stand, wherein the hook is fixed to the upper portion of the picture stand to be non-adjustable in height on the picture stand, and wherein the free end of the hook is located substantially immediately in front of the vertical display surface when. the upper portion of the picture stand leans adjacent and engages the vertical display surface such that the picture when suspended or hung from the hook is located substantially immediately adjacent the vertical display surface.

5. The picture stand of claim 4, wherein the upper and lower portions of the picture stand are angled relative to each other.

6. The picture stand of claim 5, wherein the upper portion of the picture stand lies parallel to the vertical display surface and engages the vertical display surface along the length of the upper portion when the lower portion of the picture stand engages the horizontal support surface, the picture hanging downwardly parallel to and adjacent the upper portion of the picture stand.

7. The picture stand of claim 4, wherein the upper and lower portions of the picture stand are formed adjoining sections of a curve.

8. The picture stand of claim 6, wherein the upper portion of the picture stand has symmetrical bow relative to the vertical display surface such that a central section of the bow engages the vertical display surface while the upper and lower portions of the bow are spaced forwardly of the vertical display surface by approximately equal amounts, the picture hanging vertically downwardly over the symmetrical bow in the upper portion of the picture stand.

9. The picture stand of claim 4, wherein the lower portion of the picture stand engages the horizontal support surface along a lower edge thereof.

10. The picture stand of claim 9, wherein the lower edge of the lower portion of the picture stand includes spaced feet for engaging the horizontal support surface.

11. The picture stand of claim 9, wherein the lower edge of the picture stand includes bumpers or grommets for engaging the horizontal support surface.

12. The picture stand of claim 4, wherein the upper and lower portions of the picture stand are formed as a wire frame.

13. The picture stand of claim 4, wherein the upper and lower portions of the picture stand are formed as a one-piece molded plastic picture stand.

14. A picture stand for displaying a picture in a flat, upright orientation adjacent a vertical display surface and above a horizontal support surface, which comprises:

(a) a picture stand having an upper portion and a lower portion which are configured relative to one another to permit at least some of the upper portion to lean adjacent and engage the vertical display surface when the lower portion engages adjacent the horizontal support surface, wherein the upper and lower portions of the picture stand are formed as a wire frame from a piece of wire that is bent to enclose and define an open interior space extending over the upper and lower portions of the picture stand;

(b) the upper portion of the picture stand being configured to suspend or hang the picture therefrom in an upright orientation.

15. The picture stand of claim 14, wherein the wire frame forming the upper and lower portions of the picture stand tapers inwardly as the wire frame extends upwardly such that the wire frame is narrowest along a top edge of the wire frame located above the horizontal support surface and is widest along a bottom edge of the wire frame in engagement with the horizontal support surface.

16. The picture stand of claim 14, further including a support member secured to the wire frame, the support member carrying a hook from which the picture can be suspended or hung.

17. A method of displaying a picture in a flat, upright orientation adjacent a vertical display surface and above a horizontal support surface in the manner of a picture that is hung from a nail or picture hanger that is attached to the vertical display surface without having to use a nail or picture hanger, which comprises:

(a) providing a picture stand having edge contact with the horizontal support surface along a line of contact, wherein the picture stand has a center of mass located closer to a vertical display surface than the distance between the line of contact and the vertical display surface such that the picture stand is supported in an upright orientation on the horizontal support surface only by leaning into contact with the vertical display surface, wherein the upper portion of the picture stand is configured to suspend or hang the picture therefrom in an upright orientation covering a top edge of the picture stand when the upper portion of the picture stand leans into contact with the vertical display surface; and (b) suspending or hanging a picture from the upper portion of the picture stand in an upright orientation with the picture covering the top edge of the picture stand such that no portion of the picture stand is visible above the picture.

* * * * *

UNITED STATES PATENT AND TRADEMARK OFFICE

CERTIFICATE OF CORRECTION

PATENT NO. : 6,585,218 B1
DATED : July 1, 2003
INVENTOR(S) : Nathan J. Friberg

It is certified that error appears in the above-identified patent and that said Letters Patent is hereby corrected as shown below:

Column 7,
Line 24, delete the period after “when”;
Line 40, insert -- from -- before “adjoining”;
Line 43, insert -- a -- before “symmetrical”.

Signed and Sealed this

Ninth Day of September, 2003

JAMES E. ROGAN
*Director of the United States Patent and Trademark Office*